US009876305B2

(12) United States Patent
Nishi

(10) Patent No.: US 9,876,305 B2
(45) Date of Patent: Jan. 23, 2018

(54) WIRE-TO-WIRE CONNECTOR ASSEMBLY, A WIRE-TO-WIRE CONNECTOR FOR USE IN A WIRE-TO-WIRE CONNECTOR ASSEMBLY, AND A METHOD OF LOCKING A TERMINAL OF A WIRE IN A DETACHMENT-PREVENTING MANNER IN A WIRE-TO-WIRE CONNECTOR FOR USE IN A WIRE-TO-WIRE CONNECTOR ASSEMBLY

(71) Applicant: Molex, LLC, Lisle, IL (US)

(72) Inventor: Norihiro Nishi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/509,441

(22) PCT Filed: Oct. 8, 2015

(86) PCT No.: PCT/US2015/054595
§ 371 (c)(1),
(2) Date: Mar. 7, 2017

(87) PCT Pub. No.: WO2016/060920
PCT Pub. Date: Apr. 21, 2016

(65) Prior Publication Data

US 2017/0250489 A1 Aug. 31, 2017

(30) Foreign Application Priority Data

Oct. 14, 2014 (JP) ..... 2014-209830

(51) Int. Cl.
*H01R 13/514* (2006.01)
*H01R 13/436* (2006.01)
(Continued)

(52) U.S. Cl.
CPC ..... *H01R 13/4361* (2013.01); *H01R 13/506* (2013.01); *H01R 13/502* (2013.01)

(58) Field of Classification Search
CPC ..... H01R 13/4362
(Continued)

(56) References Cited

U.S. PATENT DOCUMENTS 5,098,315 A 3/1992 Scowen
5,403,213 A 4/1995 Inaba et al.
(Continued)

FOREIGN PATENT DOCUMENTS

JP 2009-259553 A 11/2009
JP 2014-102441 A 6/2014

*Primary Examiner* — Phuong Dinh
(74) *Attorney, Agent, or Firm* — James A. O'Malley

(57) ABSTRACT

A connector composing one of two wire-to-wire connectors is provided. The connector includes a cylindrical outer housing having an insertion opening on one end for inserting the other connector of the two wire-to-wire connectors. The connector further includes an inner housing inserted into the outer housing via an assembly opening on the other end of the outer housing. The connector further includes a retainer inserted into the inner housing via a window hole provided in the cylindrical wall portion of the outer housing for locking a terminal in a detachment-preventing manner on the basis of a push-in operation after a wire with the terminal has been inserted into the terminal holding hole in the inner housing. The retainer enters first and second temporary locking states.

12 Claims, 7 Drawing Sheets

(51) Int. Cl.
*H01R 13/506* (2006.01)
*H01R 13/502* (2006.01)

(58) Field of Classification Search
USPC ..... 439/752
See application file for complete search history.

(56) References Cited

U.S. PATENT DOCUMENTS

| | | | | |
|---|---|---|---|---|
| 5,624,278 | A | 4/1997 | Kuroda et al. | |
| 8,721,375 | B2 * | 5/2014 | Hori | H01R 13/4362 439/752 |
| 9,306,326 | B2 * | 4/2016 | Nishiyama | H01R 13/4362 |
| 2007/0093131 | A1 | 4/2007 | Takahashi et al. | |
| 2015/0099404 | A1 * | 4/2015 | Iida | H01R 13/506 439/752 |

* cited by examiner

WIRE-TO-WIRE CONNECTOR ASSEMBLY, A WIRE-TO-WIRE CONNECTOR FOR USE IN A WIRE-TO-WIRE CONNECTOR ASSEMBLY, AND A METHOD OF LOCKING A TERMINAL OF A WIRE IN A DETACHMENT-PREVENTING MANNER IN A WIRE-TO-WIRE CONNECTOR FOR USE IN A WIRE-TO-WIRE CONNECTOR ASSEMBLY

RELATED APPLICATIONS

This application claims priority to Japanese Application No. 2014-209830, filed Oct. 14, 2014, which is incorporated herein by reference in its entirety.

TECHNICAL FIELD

The present disclosure relates to a connector composing one of two wire-to-wire connectors.

BACKGROUND ART

Wire-to-wire connectors are used to connect wires to each other. The connector shown in Patent Document 1 is one of two wire-to-wire connectors (the one on the receiving end). This wire-to-wire connector has a cylindrical outer housing having an insertion opening on one end for inserting the other connector of the two wire-to-wire connectors, an inner housing inserted into the outer housing via an assembly opening on the other end of the outer housing, and a retainer for preventing terminal detachment inserted into the inner housing via a window hole provided in the cylindrical wall portion of the outer housing.

This type of connector is usually shipped without wires connected, and the wire connecting operation is performed by the purchaser. The connector can be used by inserting wires with terminals into a terminal holding hole in the inner housing, and then pushing in the retainer to lock the terminal and prevent detachment. In the case of the connector shown in Patent Document 1, the outer housing has to be slid in after the retainer has been pushed in to retain the retainer.

[Patent Document 1] JP06-124745A

SUMMARY OF THE INVENTION

However, when the connector shown in Patent Document 1 is shipped without first connecting wires, the retainer may become detached from the housing during transit. Not only can the retainer become lost, the wire connection may be poor if the retainer becomes detached during the wire connecting operation.

Also, because the retainer in the connector shown in Patent Document 1 can be inserted to the pushed-in position before wires with a terminal have been inserted into the terminal holding hole in the inner housing, the retainer may prevent the wires with a terminal from being inserted into the terminal holding hole in the inner housing.

Therefore, in light of this problem, it is desirable to provide a connector able to maintain a temporary locking state in which a retainer is retained at a non-pushed-in position.

The present disclosure has been proposed in order to achieve the foregoing.

The present disclosure provides a connector composing one of two wire-to-wire connectors. The connector comprising: a cylindrical outer housing having an insertion opening on one end for inserting the other connector of the two wire-to-wire connectors; an inner housing inserted into the outer housing via an assembly opening on the other end of the outer housing; and a retainer inserted into the inner housing via a window hole provided in the cylindrical wall portion of the outer housing for locking a terminal in a detachment-preventing manner on the basis of a push-in operation after a wire with the terminal has been inserted into the terminal holding hole in the inner housing; the retainer entering a first temporary locking state when inserted into the inner housing via the window hole while the inner housing is being inserted into the outer housing, the retainer being temporarily locked at a non-pushed-in position, and entering a second temporary locking state when the inner housing is inserted into the outer housing in the first temporary locking state, the retainer being temporarily locked and retained at a non-pushed-in position.

The present disclosure further provides that the window hole has a width in the longitudinal direction greater than the width of the retainer in the longitudinal direction.

The present disclosure further provides that the retainer has an engaging claw on the surface facing the assembly opening, and the inner housing has an engaging portion engaging the engaging claw to hold the retainer in the first temporary locking state.

The present disclosure further provides that the retainer has a recessed portion on the surface facing the insertion opening, and the outer housing has a protruding portion inserted into the recessed portion to retain the retainer in the second temporary locking state.

Because the connector of the present disclosure can maintain a temporary locking state in which a retainer is retained at a non-pushed-in position, a wire can be easily connected to the connector without the retainer becoming lost.

BRIEF DESCRIPTION OF THE DRAWINGS

FIG. 5(*a*) is a perspective view showing the fitted retainer while the inner housing is being inserted, FIG. 5(*b*) is a perspective view showing the inner housing inserted into the outer housing, and FIG. 5(*c*) is a perspective view showing the pushed-in retainer.

FIG. 6(*a*) is a cross-sectional view showing the fitted retainer while the inner housing is being inserted, FIG. 6(*b*) is a cross-sectional view showing the inner housing inserted into the outer housing, and FIG. 6(*c*) is a cross-sectional view showing the pushed-in retainer.

FIG. 7(*a*) is an enlarged cross-sectional view showing the fitted retainer while the inner housing is being inserted, FIG. 7(*b*) is an enlarged cross-sectional view showing the inner housing inserted into the outer housing, and FIG. 7(*c*) is an enlarged cross-sectional view showing the pushed-in retainer.

DETAILED DESCRIPTION OF THE PREFERRED EMBODIMENTS

The following is a detailed explanation of a preferred embodiment of the present disclosure with reference to the drawings. Throughout the explanation of the embodiment the same components will be denoted by the same reference numbers.

Figure 1:
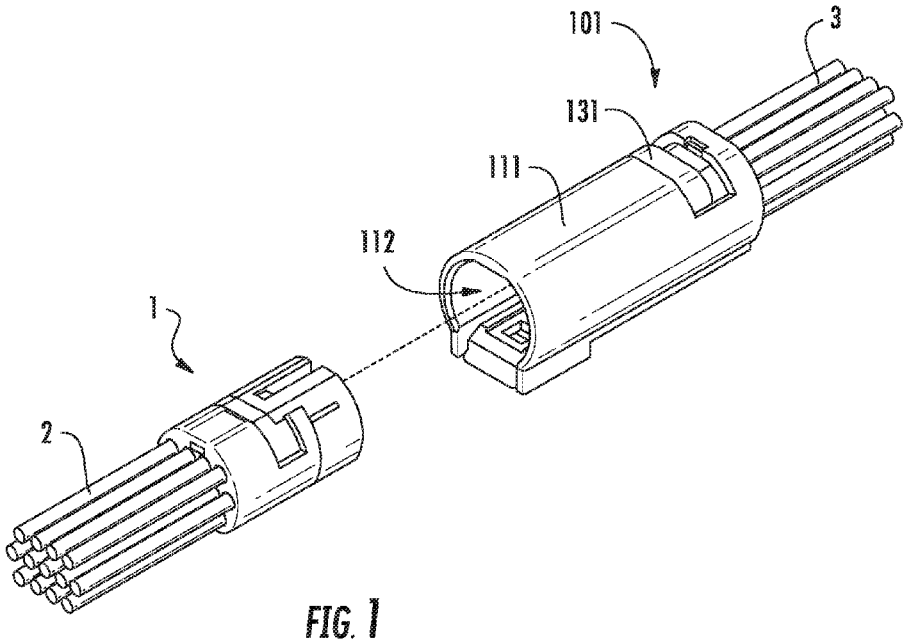
FIG. 1 is a perspective view showing a wire-to-wire connector in an embodiment of the present disclosure.

FIG. 1 is a perspective view showing a wire-to-wire connector in an embodiment of the present disclosure. As shown in the drawing, the wire-to-wire connectors consist of a connector 101 on the receiving end, and another connector 1 inserted into this connector 101. The connectors 1, 101 are shipped without any electric wires 2, 3 connected, and the purchaser connects the electric wires 2, 3. Terminals (not shown) are attached to the ends of the electric wires 2, 3, and the terminals on the electric wires 2, 3 come into contact and establish an electrical connection when the one connector 101 is inserted into the other connector 1. The following is an explanation of the one connector 101 in the present disclosure with reference to FIG. 1 through FIG. 7.

Figure 2:
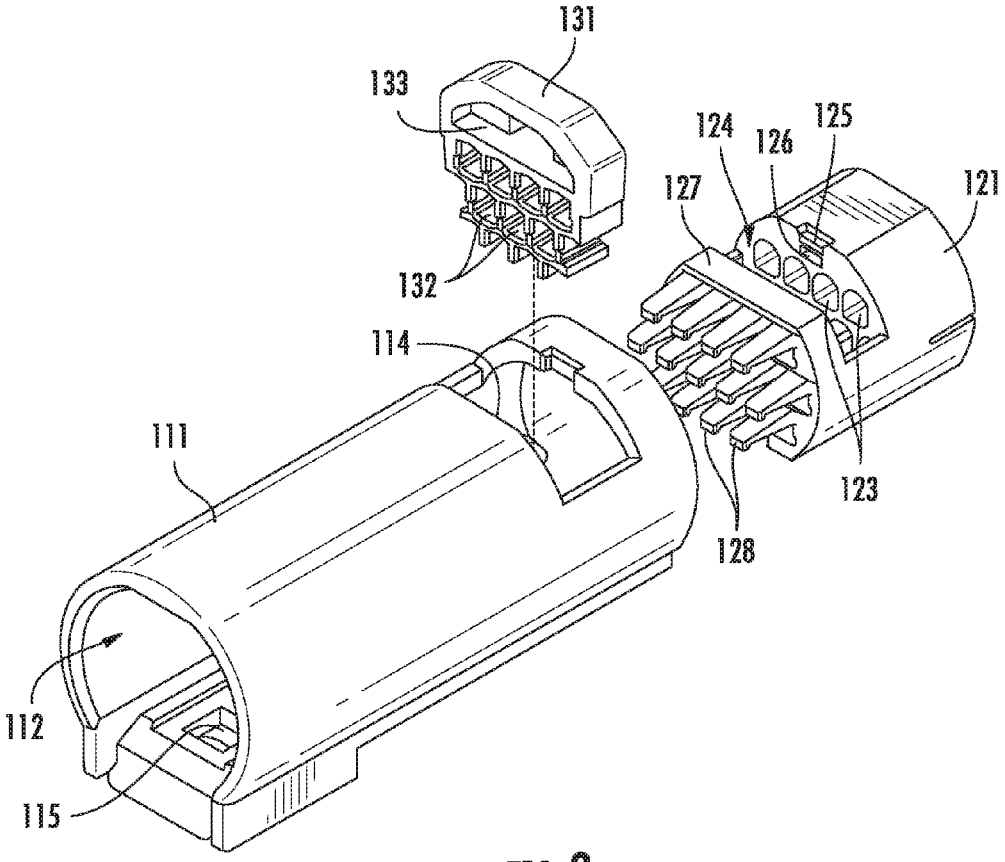
FIG. 2 is an exploded perspective view showing the connector in the embodiment of the present disclosure from above.
Figure 3:
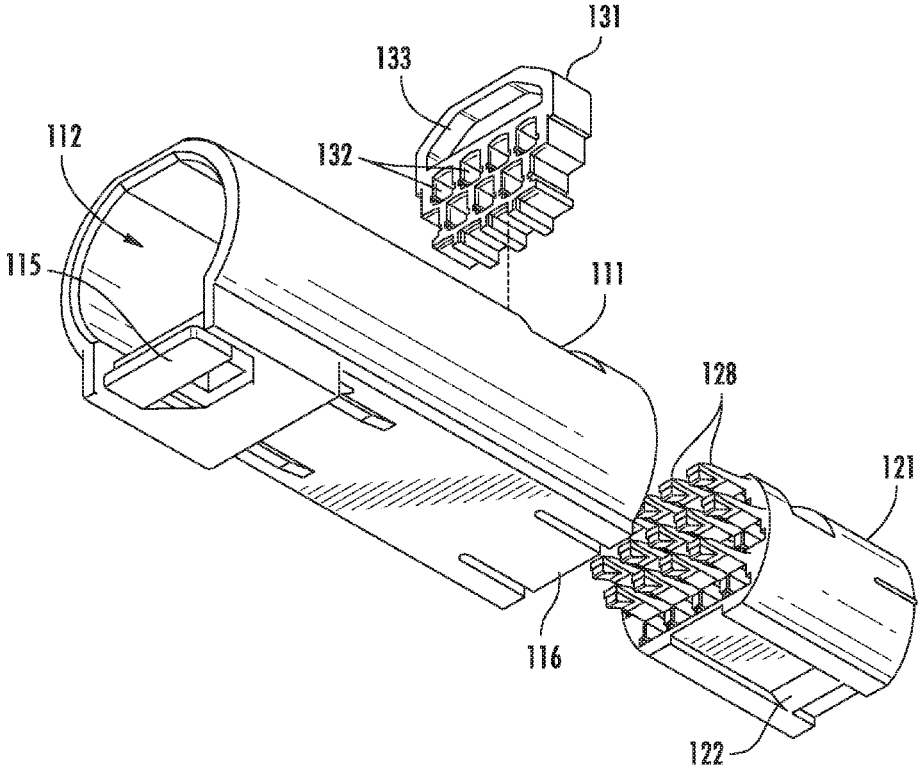
FIG. 3 is an exploded perspective view showing the connector in the embodiment of the present disclosure from below.
Figure 4C:
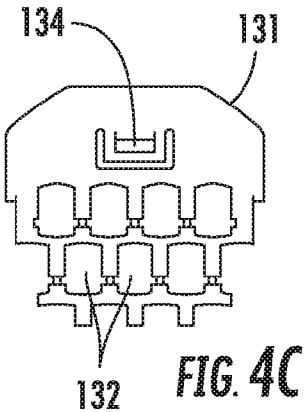
FIG. 4(*a*) is an exploded side view of the connector in the embodiment of the present disclosure, FIG. 4(*b*) is a front view of the retainer, and FIG. 4(*c*) is a rear view of the retainer.
Figure 4B:
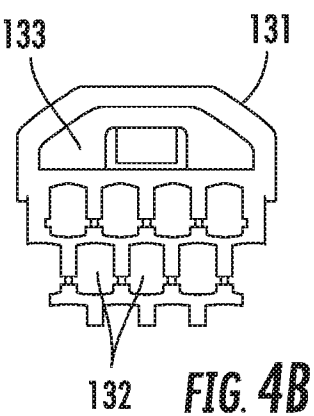
Figure 4A:
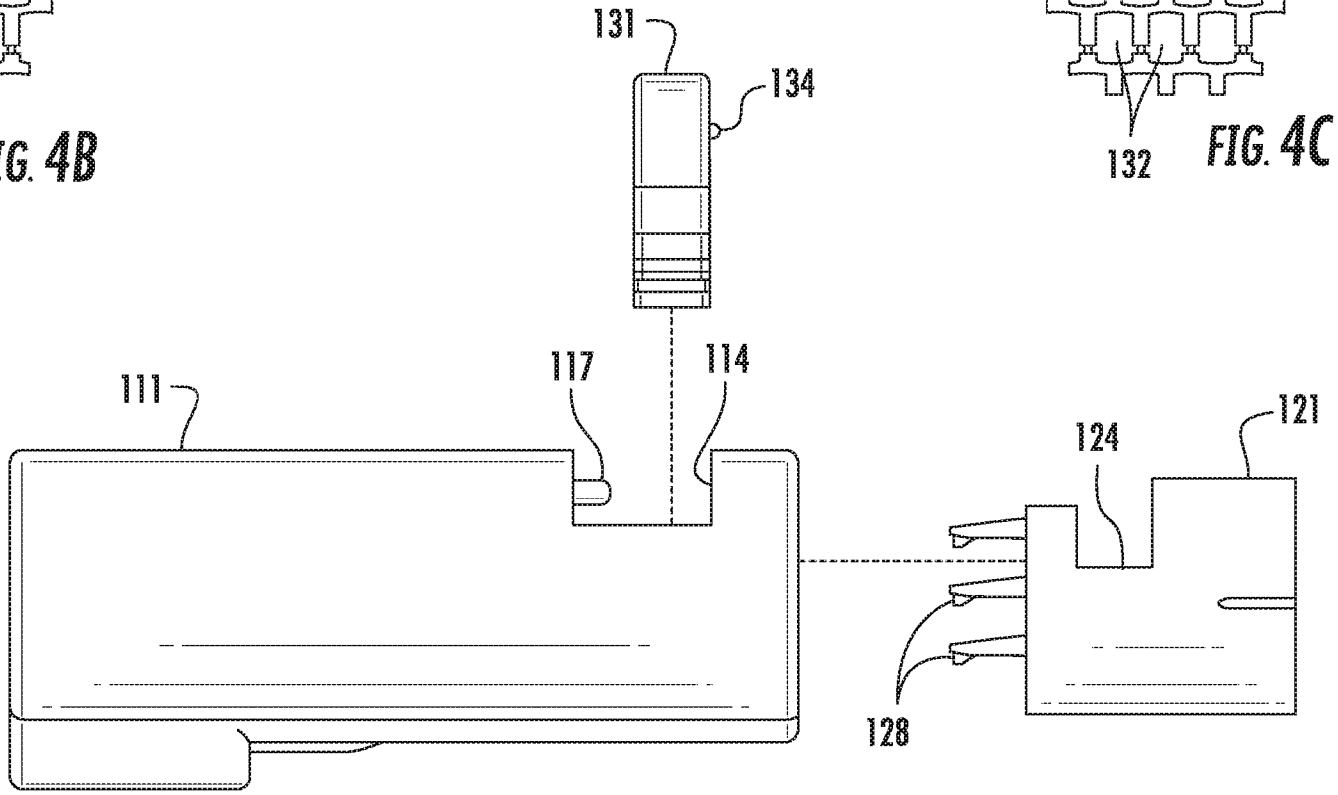

FIG. 2 is an exploded perspective view showing the connector in the embodiment of the present disclosure from above, and FIG. 3 is an exploded perspective view showing the connector in the embodiment of the present disclosure from below. In FIG. 4, (a) is an exploded side view of the connector in the embodiment of the present disclosure, (b) is a front view of the retainer, and (c) is a rear view of the retainer. As shown in these drawings, the connector 101 has a cylindrical outer housing 111 having an insertion opening 112 on one end for inserting the other connector 1 of the two wire-to-wire connectors, an inner housing 121 inserted into the outer housing 111 via an assembly opening 113 on the other end of the outer housing 111, and a retainer 131 inserted into the inner housing 121 via a window hole 114 provided in the cylindrical wall portion of the outer housing 111.

The outer housing 111 is substantially cylindrical, but the ceiling portion and floor portion of the inner peripheral portion are flat. A locking portion 115 is provided at the front end of the floor portion to lock the other connector 1 inserted into the insertion opening 112, and a locking portion 116 is provided at the rear end of the floor portion to lock the inner housing 121 inserted into the assembly opening 113.

A window hole 114 which is rectangular in plan view is formed at the rear end of the upper portion of the outer housing 111. The width of the window hole 114 in the transverse direction is substantially the same as the width of the retainer 131 in the transverse direction, but the width of the window hole 114 in the longitudinal direction is larger than the width of the retainer 131 in the longitudinal direction. This allows the inner housing 121 to be slidably inserted into the outer housing 111 even when the upper portion of the retainer 131 inserted into the inner housing 121 protrudes outward through the window hole 114. A protruding portion 117 extending to the rear is provided on the front edge of the window hole 114.

The inner housing 121 is substantially columnar, but an upper surface portion and a bottom surface portion are flat. A locking claw 122 is formed at the rear end of the bottom surface which is locked by the locking portion 116 of the outer housing 111.

A plurality of terminal holding holes 123 are formed in the inner housing 121 so as to pass through in the longitudinal direction. A plurality of electric wires 3 with terminals are inserted from the rear into these terminal holding holes 123. The inner housing 121 opens upward and a retainer holding hole 124 is formed which communicates with the terminal holding holes 123. Here, the retainer 131 is inserted from above. A groove-like engaging portion 125 is formed on the rear edge of the retainer holding hole 124, and an engaging hole 126 is formed in the wall surface on the lower end.

In the inner housing 121, a front wall portion 127 is provided in front of the retainer holding hole 124. A plurality of terminal holding pieces 128 extending in the forward direction are provided on the front surface of the front wall portion 127, and the front ends of the terminals inserted into the terminal holding holes 123 are held by the terminal holding pieces 128.

The retainer 131 is inserted from above into the retainer holding hole 124 in the inner housing 121 via the window hole 114 in the outer housing 111. A plurality of terminal holding holes 132 are formed in the retainer 131 so as to pass through in the longitudinal direction, and the middle portion of the terminals inserted into the inner housing 121 are inserted into and held by the terminal holding holes 132 in the retainer 131. Because an upward-facing recessed portion is formed in the middle portion of the terminals, the upper edges of the terminal holding holes 132 are inserted into the recessed portions of the terminals and the terminals are secured by pushing the retainer 131 downward after the terminals have been inserted.

The upper end portion of the retainer 131 has a shape which follows the contour of the upper surface of the outer housing 111. This protrudes upwardly from the upper surface of the outer housing 111 when it has not been pushed in. However, it becomes flush with the upper surface of the outer housing 111 when pushed in. A recessed portion 133 opening towards the front is formed in the front surface of the retainer 131 at the upper end, and an engaging claw 134 protruding towards the rear is provided in the rear surface of the retainer 131 at the upper end.

Figure 5C:
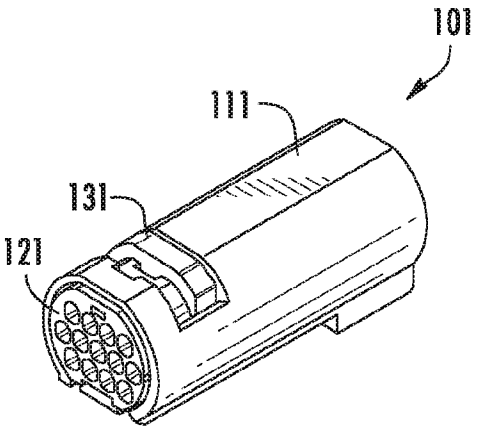
FIG. 5 is a series of diagrams showing the state transition when the connector in the embodiment of the present disclosure is connected.
Figure 5B:
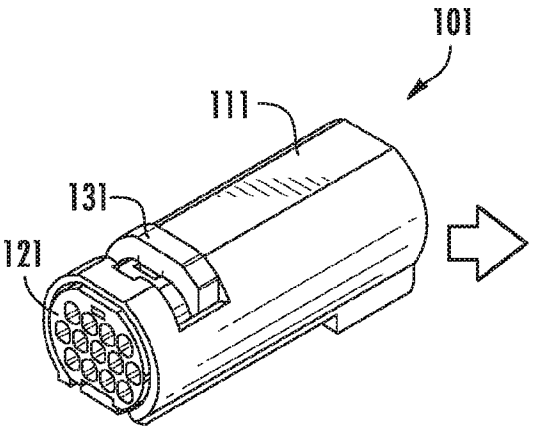
Figure 5A:
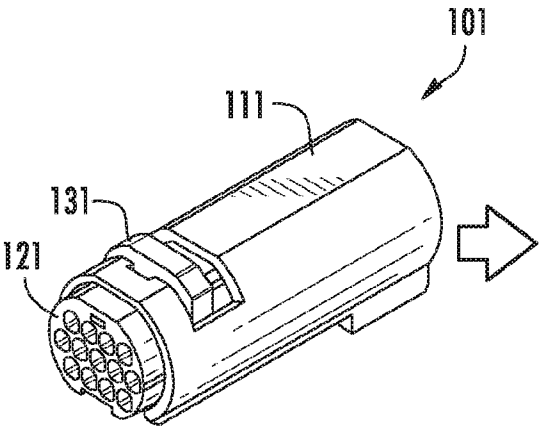
Figure 6C:
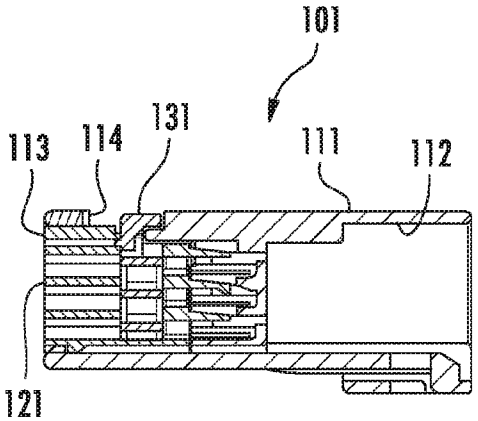
FIG. 6 is a series of diagrams showing the state transition when the connector in the embodiment of the present disclosure is connected.
Figure 6B:
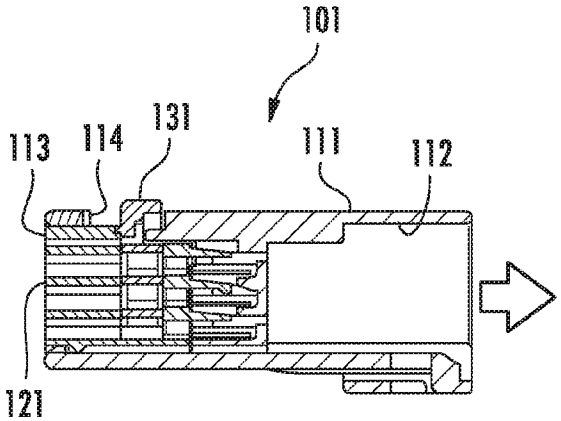
Figure 6A:
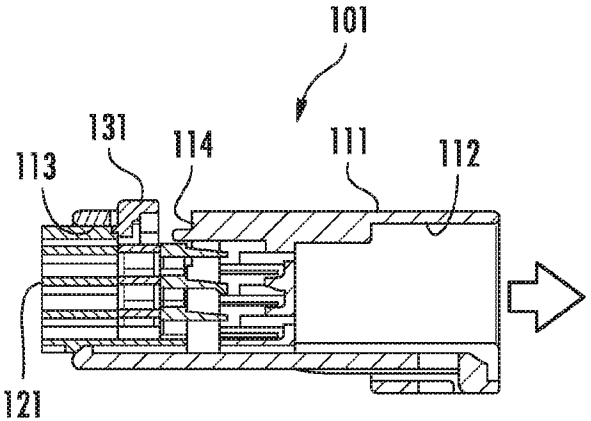
Figure 7C:
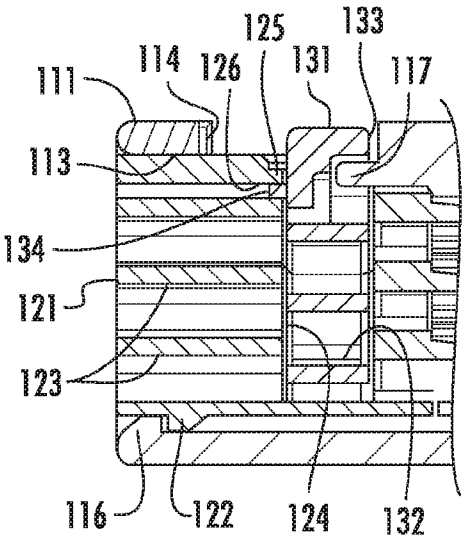
FIG. 7 is a series of diagrams showing the state transition when the connector in the embodiment of the present disclosure is connected.
Figure 7B:
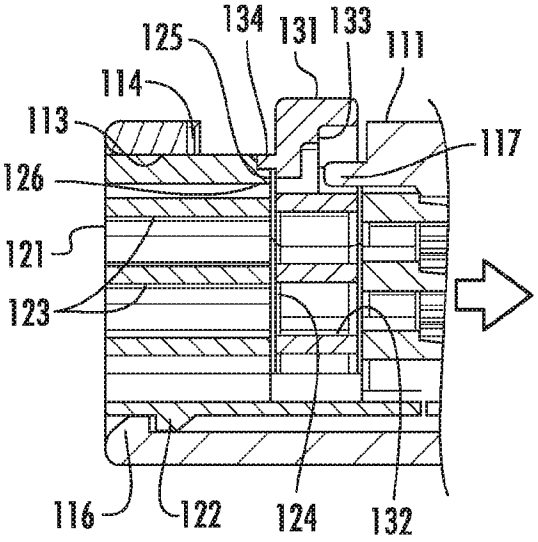
Figure 7A:
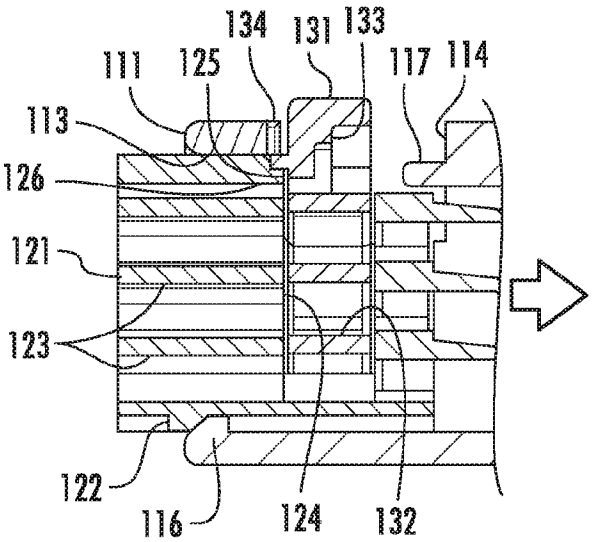

The following is an explanation of the operations performed to assemble the connector 101 and to connect wires with reference to FIG. 5 through FIG. 7.

FIG. 5 is a series of diagrams showing the state transition when the connector in the embodiment of the present disclosure is connected. FIG. 5(*a*) is a perspective view showing the fitted retainer while the inner housing is being inserted, FIG. 5(*b*) is a perspective view showing the inner housing inserted into the outer housing, and FIG. 5(*c*) is a perspective view showing the pushed-in retainer. FIG. 6 is a series of diagrams showing the state transition when the connector in the embodiment of the present disclosure is connected. FIG. 6(*a*) is a cross-sectional view showing the fitted retainer while the inner housing is being inserted, FIG. 6(*b*) is a cross-sectional view showing the inner housing inserted into the outer housing, and FIG. 6(*c*) is a cross-sectional view showing the pushed-in retainer. FIG. 7 is a series of diagrams showing the state transition when the connector in the embodiment of the present disclosure is connected. FIG. 7(*a*) is an enlarged cross-sectional view showing the fitted retainer while the inner housing is being inserted, FIG. 7(*b*) is an enlarged cross-sectional view showing the inner housing inserted into the outer housing, and FIG. 7(*c*) is an enlarged cross-sectional view showing the pushed-in retainer.

As shown in FIG. 5(*a*) through FIG. 7(*a*), when the connector 101 is assembled, the inner housing 121 is first inserted into the assembly opening 113 in the outer housing 111. At this time, the insertion of the inner housing 121 suddenly stops when the locking claw 122 of the inner housing 121 cannot overcome the locking portion 116 of the outer housing 111, and the retainer 131 is attached.

The retainer 131 is then inserted into the retainer holding hold 124 in the inner housing 121 via the window hole 114 in the outer housing 111. At this time, the engaging claw 134 formed in the rear surface of the retainer 131 at the upper end engages the engaging portion 125 formed in the rear edge of the retainer holding hole 124, and the retainer 131 enters the first temporary locking stage at which it has not been pushed in.

Next, as shown in FIG. 5(*b*) through FIG. 7(*b*), the inner housing 121 is pushed in to the normal insertion assembly position on the outer housing 111. At this time, the locking claw 122 on the inner housing 121 overcomes the locking portion 116 on the outer housing 111, and the inner housing 121 is locked and assembled in the outer housing 111.

Because the retainer 131 is pushed in along with the inner housing 121, the recessed portion 133 formed in the front surface of the retainer 131 at the upper end moves closer to the protruding portion 117 formed on the front edge of the window hole 114 in the outer housing 111, and the protruding portion 117 is eventually inserted into the recessed portion 133. As a result, the retainer 131 temporarily locked at a non-pushed-in position enters the second temporary locked state where it is retained by the protruding portion 117.

When the retainer 131 is attached at the second temporary locking state, the connector 101 can be shipped without any electric wires 3 connected and the retainer 131 will not become detached during transit or at the place of purchase. As a result, the retainer 131 is not lost, and the electric wires 3 can be connected without the retainer 131 falling out during the electric wire 3 connecting process.

When the electric wires 3 are connected to the connector 101 by the purchaser, as shown in FIG. 5(*b*) through FIG. 7(*b*), electric wires 3 with terminals are first inserted from the rear into the terminal holding holes 123 in the inner housing 121. Because the retainer 131 is temporarily locked at a non-pushed-in position at this time, it cannot be pushed in to the pushed-in position to obstruct the insertion of the electric wires 3 with terminals.

When the wires 3 with terminals have been fully inserted, the retainer 131 is pushed in as shown in FIG. 5(*c*) through FIG. 7(*c*). When the retainer 131 is pushed in, the retainer 131 is fitted into the recessed portions of the terminals to keep the terminals from becoming detached. When the engaging claw 134 formed on the rear surface at the upper end overcomes the engaging portion 125 formed on the rear edge of the retainer holding hole 124 and engages the engaging hole 126, the retainer 131 is locked in the pushed-in position.

The embodiment described above is a connector 101 composing one of two wire-to-wire connectors, and this connector includes: a cylindrical outer housing 111 having an insertion opening 112 on one end for inserting the other connector 1 of the two wire-to-wire connectors; an inner housing 121 inserted into the outer housing 111 via an assembly opening 113 on the other end of the outer housing 111; and a retainer 131 inserted into the inner housing 121 via a window hole 114 provided in the cylindrical wall portion of the outer housing 111 for locking terminals in a detachment-preventing manner on the basis of a push-in operation after a wires 3 with terminals have been inserted into the terminal holding holes 123 in the inner housing 121; the retainer 131 entering a first temporary locking state when inserted into the inner housing 121 via the window hole 114 while the inner housing 121 is being inserted into the outer housing 111, the retainer being temporarily locked at a non-pushed-in position, and entering a second temporary locking state when the inner housing 121 is inserted into the outer housing 111 in the first temporary locking state, the retainer being temporarily locked and retained at a non-pushed-in position. In this way, the wires 3 can be easily connected to the connector 101 without losing the retainer 131.

Also, the retainer 131 has an engaging claw 134 on the surface facing the assembly opening 113, and the inner housing 121 has an engaging portion 125 engaging the engaging claw 134 to hold the retainer 131 in the first temporary locking state. In this way, the retainer 131 can be retained in the first temporary locking state without increasing the number of components or making the structure more complicated.

Also, the retainer 131 has a recessed portion 133 on the surface facing the insertion opening 112, and the outer housing 111 has a protruding portion 117 inserted into the recessed portion 133 to retain the retainer 131 in the second temporary locking state. In this way, the retainer 131 can be retained in the second temporary locking state without increasing the number of components or making the structure more complicated.

A preferred embodiment of the present disclosure was described above. However, the present disclosure is not limited to the embodiment described above. Many variations are possible based on the spirit of the disclosure described in the claims, and these do not depart from the scope of the present disclosure.

The invention claimed is:

1. A wire-to-wire connector for use in a wire-to-wire connector assembly, the wire-to-wire connector comprising:

an outer housing having an outer wall defining an aperture which extends therethrough from a first end of the outer housing to the second end of the outer housing, the outer housing having a window hole provided through the outer wall which is in communication with the aperture;

an inner housing which is configured to be positioned within the aperture of the outer housing and locked to the outer housing, the inner housing having a terminal holding hole extending therethrough; and a retainer which is configured to be inserted into the inner housing via the window hole, wherein, while the inner housing is partially inserted into the outer housing, the retainer is configured to be inserted into the inner housing via the window hole and to enter a first temporary locking state at a non-pushed-in position, wherein, when the inner housing is completely inserted into and locked to the outer housing, the retainer enters a second temporary locking state at a non-pushed-in position, and wherein, after a wire with a terminal has been inserted into the terminal holding hole, and after the retainer has entered the second temporary locking state, the retainer is configured to lock the terminal of the wire in a detachment-preventing manner on a basis of a push-in operation.

2. The wire-to-wire connector according to claim 1, wherein the window hole has a width in a longitudinal direction greater than a width of the retainer in the longitudinal direction.

3. The wire-to-wire connector according to claim 1, wherein the retainer has an engaging claw on a surface facing the second end of the outer housing, and the inner housing has an engaging portion engaging the engaging claw to hold the retainer in the first temporary locking state.

4. The wire-to-wire connector according to claim 1, wherein the retainer has a recessed portion on a surface facing the first end of the outer housing, and the outer housing has a protruding portion inserted into the recessed portion to retain the retainer in the second temporary locking state.

5. The wire-to-wire connector according to claim 1, wherein the outer housing is substantially cylindrical in configuration.

6. A wire-to-wire connector assembly comprising:

a first wire-to-wire connector, the first-wire-to-wire connector having an outer housing, an inner housing, a retainer, and a first wire having a first terminal, the outer housing having an outer wall defining an aperture which extends therethrough from a first end of the outer housing to the second end of the outer housing, the outer housing having a window hole provided through the outer wall which is in communication with the aperture, the inner housing being configured to be positioned within the aperture of the outer housing and locked to the outer housing, the inner housing having a terminal holding hole extending therethrough, the retainer being configured to be inserted into the inner housing via the window hole; and a second wire-to-wire connector having a second wire having a second terminal, the second wire-to-wire connector configured to be inserted into the aperture of the outer housing via the first end of the outer housing in order to electrically connect the second terminal of the second wire to the first terminal of the first wire, wherein, while the inner housing is partially inserted into the outer housing, the retainer is configured to be inserted into the inner housing via the window hole and to enter a first temporary locking state at a non-pushed-in position, wherein, when the inner housing is completely inserted into and locked to the outer housing, the retainer enters a second temporary locking state at a non-pushed-in position, and wherein, after the first wire with the first terminal has been inserted into the terminal holding hole, and after the retainer has entered the second temporary locking state, the retainer is configured to lock the first terminal of the first wire in a detachment-preventing manner on a basis of a push-in operation.

7. The wire-to-wire connector assembly according to claim 6, wherein the window hole has a width in a longitudinal direction greater than a width of the retainer in the longitudinal direction.

8. The wire-to-wire connector assembly according to claim 6, wherein the retainer has an engaging claw on a surface facing the second end of the outer housing, and the inner housing has an engaging portion engaging the engaging claw to hold the retainer in the first temporary locking state.

9. The wire-to-wire connector assembly according to claim 6, wherein the retainer has a recessed portion on a surface facing the first end of the outer housing, and the outer housing has a protruding portion inserted into the recessed portion to retain the retainer in the second temporary locking state.

10. The wire-to-wire connector assembly according to claim 6, wherein the outer housing is substantially cylindrical in configuration.

11. A method of locking a terminal of a wire in a detachment-preventing manner in a wire-to-wire connector for use in a wire-to-wire connector assembly, the method comprising the steps of:

a) providing a wire having a terminal;

b) providing a wire-to-wire connector having an outer housing, an inner housing and a retainer, the outer housing having an outer wall defining an aperture which extends therethrough from a first end of the outer housing to the second end of the outer housing, the outer housing having a window hole provided through the outer wall which is in communication with the aperture, the inner housing having a terminal holding hole extending therethrough;

c) partially inserting the inner housing into the aperture of the outer housing via the first end of the outer housing;

d) inserting the retainer into the inner housing via the window hole such that the retainer enters a first temporary locking state at a non-pushed-in position;

e) fully inserting the inner housing into the aperture of the outer housing via the first end of the outer housing in order to lock the inner housing to the outer housing, whereby the retainer enters a second temporary locking state at a non-pushed-in position;

f) inserting the wire with the terminal into the terminal holding hole; and g) pushing-in the retainer to lock the terminal of the wire in a detachment-preventing manner.

12. The method as defined in claim 11, wherein step f) is performed prior to step e).

* * * * *